United States Patent [19]

Sparrow

[11] Patent Number: 4,782,558

[45] Date of Patent: Nov. 8, 1988

[54] TILTABLE BUTTON

[75] Inventor: Timothy H. Sparrow, Harrodsburg, Ky.

[73] Assignee: Universal Fasteners Inc., Lawrenceburg, Ky.

[21] Appl. No.: 48,257

[22] Filed: May 11, 1987

[51] Int. Cl.[4] ..... A44B 1/38

[52] U.S. Cl. ..... 24/90 R; 24/108

[58] Field of Search ..... 24/90 R, 92, 94, 108, 24/102 PL, 113 MP

[56] References Cited

U.S. PATENT DOCUMENTS

| | | | |
|---|---|---|---|
| 485,848 | 11/1892 | Perrine | 24/108 |
| 582,066 | 5/1897 | Hyde, Jr. | 24/94 |
| 1,434,491 | 11/1922 | Hubbell | 24/90 R |
| 2,118,561 | 5/1938 | Kleeberg | 24/90 R |
| 2,538,396 | 1/1951 | Sutin | 24/108 |
| 2,901,796 | 9/1959 | Hope | 24/108 |
| 3,643,296 | 2/1972 | Kahn | 24/108 |
| 3,705,443 | 12/1972 | Camporese et al. | 24/90 R |
| 4,541,148 | 9/1985 | Watanabe | 24/108 |

FOREIGN PATENT DOCUMENTS

| | | | |
|---|---|---|---|
| 867888 | 5/1961 | United Kingdom | 24/90 R |

*Primary Examiner*—Victor N. Sakran

*Attorney, Agent, or Firm*—Hill, Van Santen, Steadman & Simpson

[57] ABSTRACT

A button secured by a rivet to a sheet of compliant material includes an elastic body having a dish-shaped web whose peripheral rim carries the button cap. The web is of uniform construction through its circumference for consistent resiliency whereby the button can be easily tilted from its normal position so as to be readily inserted through the buttonhole of an article.

12 Claims, 1 Drawing Sheet

TILTABLE BUTTON

BACKGROUND OF THE INVENTION

1. Field of the Invention

The invention relates to a button that is secured to a fabric or the like and which has a head that can be tilted.

2. Description of the Prior Art

Numerous buttons are in use which generally include a button body and a rivet member for securing the button to a fabric. Typically, a button cap, which can serve as an ornamental decorative part of the button, is permanently attached to the head of the button body. It is desireable that the head and cap of the button be mounted to tilt within a limited arc relative to that central axis which is common to both the button body and the rivet member, whereby the head of the button can be canted relative to the plane of the fabric to which it is secured so as to be more easily inserted into and through a buttonhole to fasten two members of an article or garment together.

The prior art, as exemplified by U.S. Pat. Nos. 3,958,307 and 4,541,148, each discloses a button having a head that can be tilted relative to the common central axis passing through both the button body and the rivet that pierces the fabric and is inserted into the base of the button body to secure the button to the fabric. In Ishizaki, U.S. Pat. No. 3,958,307, a button top is carried by a support plate that has an expansible central opening which can accept an enlarged head of the main body of the button whereby the button top is pivotally and rotatably mounted to the main body. A disadvantage of this button is that the button top can disengaged from the enlarged ed, either intentionally or by accident, if a sufficient force is exerted thereon; and, any ornamental configuration or design on the button top must be one that does not require orientation. U.S. Pat. No. 4,541,148 has a pair of oppositely disposed upstanding curved webs that support and interconnect disk-like portion, covered by a cap, with a socket portion. However, the structure of the paired webs does not permit the button to be tilted substantially the same arcuate distance under a given force at ever point throughout its circumference, as the placement of the bs allows the button to be more readily tilted in a first direction in which the webs are positioned in alignment with each other rather than in a second direction in which the webs are positioned in a side-by-side relationship, the second direction being spaced 90° from the first direction. Further, a metal button back member of a complex tubular configuration cooperates with the socket portion to support and maintain the cap and disk portions in an upright position coaxial with the central axis of the button.

As described hereinafter, the button of the subject invention is constructed with a minimum of structural elements and can be readily and easily tilted in ny direction.

SUMMARY OF THE INVENTION

The invention is summarized as a tiltable button that is applied to compliant sheet material and include a body member formed of elastic material having a centrally disposed cylindrical post that has a recess therein to accommodate a rivet, an upwardly flaring resilient web portion formed integrally with the base and surrounding the post and carrying a ring portion on the outer circumferential rim of the web portion, a cap secure to the ring portion to form a cover or head for the button, and a rivet to first pierce the material after which it enters and is retained within the recess of the post to thereby secure the button to the material whereby the cap member mounted by the ring to the web can be tilted in any direction relative to the central axis of the body and against the resilience of the web portion.

An object f tis invention is to construct a button having an elastic body whose head can be readily nd easily tilted at any point throughout its periphery.

Another object of this invention is a structure that utilizes a minimum number of elements to construct a tiltable button.

Other objects, advantages and features of the invention ill be apparent from the following description of the preferred embodiments taken in conjunction with the accompanying drawings.

DESCRIPTION OF THE PREFERRED EMBODIMENT

Figure 1:
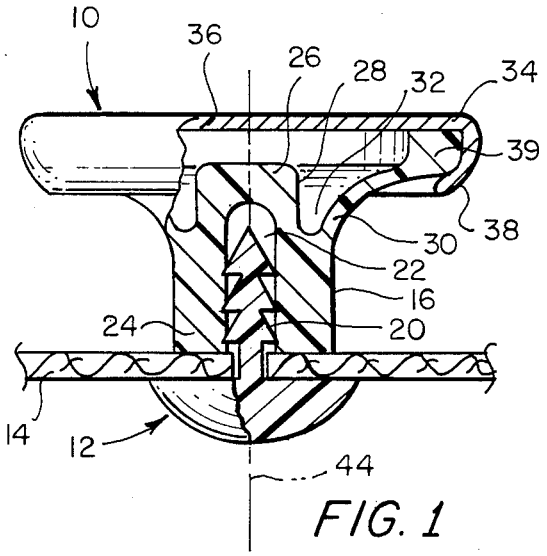
FIG. 1 is a diagrammatical view, partly in section of the button embodying the present invention secured to a sheet of compliant material by a rivet.
Figure 5:
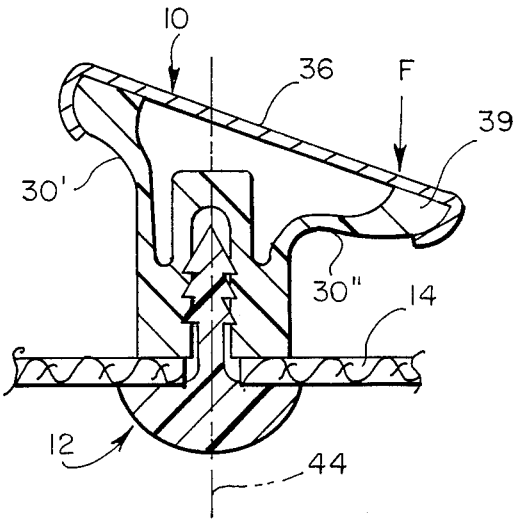
FIG. 5 is a vertical cross sectional view similar to FIG. 1 showing the button body tilted with respect to the central axis of the rivet; and, FIG. 6 is a perspective view, partly in section, of another embodiment of the button.

As illustrated in FIGS. 1 and 5 of the drawings, a button and rivet, generally indicated as 10 and 12, respectively, are secured together with a sheet of compliant material, such as a fabric 14 interposed therebetween. Although the apparatus for assembling the button and rivet is not shown, the general details of the structure and operation of the apparatus is well known in the art, and one embodiment of such apparatus is shown and described in the patent to Schmidt, et al U.S. Pat. No. 3,803,698.

In FIG. 1, there is shown a button body 16 of button 1 nd a rivet head 18 of rivet 12 that embody the present invention and include a pronged member 20 formed integrally with head 18 that pierce compliant material 14 and is seated in recess 22 to thereby join button body 1 of button 10 and rivet 12 together with material 14 located therebetween.

Figure 2:
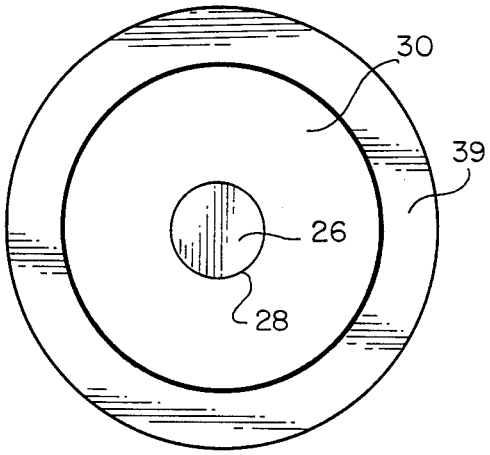
FIG. 2 is a top view of the button body.
Figure 3:
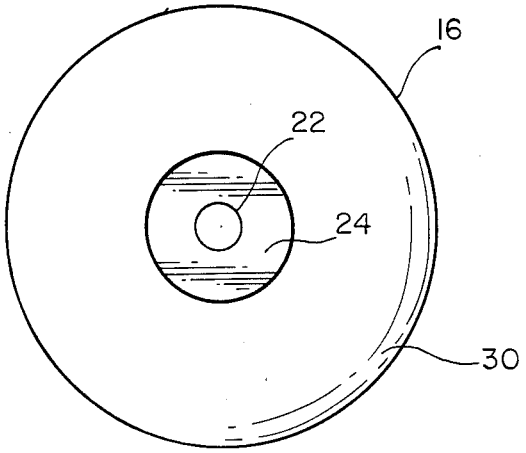
FIG. 3 is a bottom view of the button body.

As shown in FIGS. 1–3, body 16 has a base 24 that can be of any particular shape, but is shown in the drawings as being circular in cross section to better accept a buttonhole in a garment. Recess 22 is centrally disposed in base 24 and has a diameter that is slightly smaller tan the diameter of pronged member 20 so that when rivet 12 is driven toward body 16, pronged member 20 will enter and be held within recess 22 to join button body 16 an rivet 12 together. A cap 26 closes the upper end of recess 22 to form post 28, and as shown in FIGS. 1–5 is circular in cross section. Post 28 can be formed without cap 26, so that it is open at both ends. However, cap 26 provides structural support to body 16 and rivet 12 when assembled together.

A dish shaped web 3 surrounds post 2, and is formed integrally with body 1 to flare upwardly and outwardly from base 24 to thereby define a circular internal relief 32 that is located intermediate web 30 and post 2. Rim 34 is located at the outermost periphery of web 3 in a plane that is positioned above cap 2 of post 2. A cap 36, generally formed of a malleable material, such plastic or sheet metal, covers the upper portion o body 16 and as its peripheral portion 38 crimped or turned down so as to secure cap 36 to rim 34 of web 30, to form a head for button 10. Rim 34 can be enlarged to a width greater than the thickness of web 30 to form a structural ring member 39 to better support and secure cap 36 to body 16.

Figure 4:
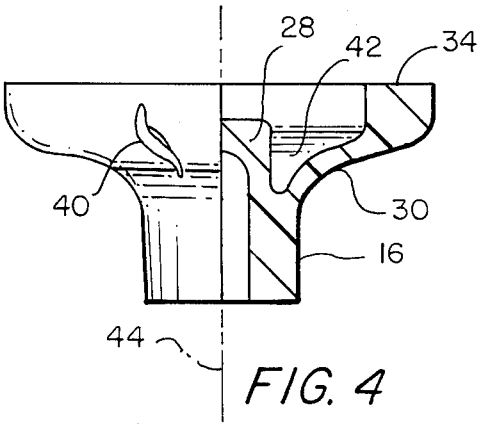
FIG. 4 is a plan view, partly in cross section, of other embodiments of the button body.

Web 30 can have various thicknesses throughout its length extending from post 28 to rim 34; or, as sown in FIG. 4, a plurality of cutouts 4 can be located in the all of web 3, or a plurality of ribs 42 extending between we 30 and post , to obtain the desired resiliency of the button when it is tilted relative to the axis 44 that extends through the central axis of button body 1 and rivet 12. Cutouts 40 and ribs 42 are symmetrically spaced about pt 28, with the thickness of the web being uniform throughout its periphery to obtain the desired tilt characteristic to the button.

Also, the design nd structure of button body 1 is such that body 1 will readily support web 30 and the head of button 10 including ring member 34 nd cap 36 in an upright position while still providing acceptable resiliency to perform as a button under greater than normal loads.

Figure 6:
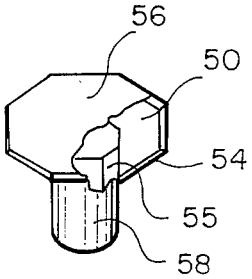

Further, while the components of button 1 have been sown as circular in configuration, the button body can be of any configuration e.g.: square, octagonal, etc., as long as post 28, web 3, and rim 34 have the same symetrical configuration. An example is shown in FIG. 6, in which web 5, ring member 54, and cap 56 have an octagonal shape while base 5 ha a circular configuration.

In operation, a shown in FIG. 5, the right edge portion of button 1 is pushed downwardly by a force F or the left edge is pulled upwardly by a similar force to tilt cap 36 in clockwise direction relative to axis 44 and the plane of fabric 14. Ring 3 moves with cap 3 to extend that portion of web 30 to the left of central axis 44 and to depress that portion of web 30 to the right of central axis 44 in a uniform manner under force F, hereby button 10 can be easily threaded through or removed from a button hole (not shown) with a maximum of ease.

Once button 1 is inserted into a button hole or removed therefrom, the resiliency of the material from which button body 1 is molded will return button cap 3 to its normal condition in which the cap is parallel to the horizontal plane of fabric.

Inasmuch as the present invention is subject to many variations, modifications and changes in detail, it is intended that all matter contained in the foregoing description or shown on the accompanying drawings shall be interpreted as illustrative and not in a limiting sense.

What is claimed is:

1. A button for attachment to compliant sheet material comprising:

a unitary button body formed of elastic material and including a post member having a closed top and a centrally disposed opening extending from the bottom of said body, an upwardly flaring dishshaped resilient web portion formed to circumferentially surround said post and having a peripheral rim formed at the outermost edge of said web, a cap secured to said rim to cover said button;

a rivet having a head and a shank projecting centrally from said head to pierce said sheet material, enter into and be retained within said opening of said body to join said rivet to said body with said material interposed therebetween;

wherein said cap mounted to said web portion can be tilted in any direction relative to the central axis of said body and said rivet against the resilience of said web portion.

2. A button as claimed in claim 1 wherein said peripheral rim includes a ring member of enlarged uniform cross section to which said cap member is secured.

3. A button as claimed in claim 2 wherein said ring member includes a substantially rigid structure to maintain itself and the cap mounted thereto in a given plane when tilted.

4. A button as claimed in claim 3 wherein said cap includes a peripheral portion positioned to overlie and be turned under said ring member to secure said cap thereto.

5. A button as claimed in claim 4 wherein said cap member is formed of substantially malleable material.

6. A button as claimed in claim 1, herein said dish-shaped web portion projects outwardly from said post at a distance substantially intermediate the eight of said post to form an internal relief separating the inner surfaces of said web from said post hereby said cap can be readily tilted.

7. A button as claimed in claim 6, herein plurality of symetrically spaced cutouts are located in said dish-shaped web.

8. A button as claimed in claim 6, wherein a plurality of rib members located in said internal relief interconnect said post to said web member.

9. A button as claimed in claim 1 wherein the base said button body is circular in cross section for cooperation of said rivet, said post and web portion having flat all portions identical in number to the number of edge portions on said cap member.

10. A button claimed in claim 9, wherein said base of said button as the same number of sides as the number of edge portions on said cap member.

11. A button for attachment to compliant sheet material comprising:

a unitary button body formed of elastic material and including a post member having a closed top and a centrally disposed opening extending along a central axis from the bottom of said body, an upwardly flaring dish-shaped resilient web portion formed to circumferentially surround said post and having a peripheral rim formed at the outermost edge of said web in a plane perpendicular to said axis;

a cap secured to said rim to cover said button; and a rivet having a head and a shank projecting centrally from said head to pierce said sheet material, enter into and be retained within said opening of said body to join said rivet to said body with said material interposed therebetween;

wherein, upon application of a force, said cap mounted to said web portion can be tilted relative to the central axis of said body and said rivet against the resilience of said web portion and, upon removal of said force, said resilient body and web portion will return said cap to its normal condition in which the cap is in said plane perpendicular to said axis.

12. A button for attachment to compliant sheet material comprising:

a unitary button body formed of elastic material and including a post member having a closed top and a centrally disposed opening extending along a central axis from the bottom of said body, an upwardly flaring dish-shaped resilient web portion formed to circumferentially surround said post and having a peripheral rim formed at the outermost edge of said web in a plane perpendicular to said axis; and a rivet having a head and a shank projecting centrally from said head to pierce said sheet material, enter into and be retained within said opening of said body to join said rivet to said body with said material interposed therebetween;

wherein, upon application of a force, said peripheral rim can be tilted in any direction relative to the central axis of said body and said rivet against the resilience of said web portion and, upon removal of said force, said resilient body and web portion will return said peripheral rim to its normal position in which the rim is in said plane perpendicular to said axis.

* * * * *